US006532748B1

(12) United States Patent
Yuan et al.

(10) Patent No.: US 6,532,748 B1
(45) Date of Patent: Mar. 18, 2003

(54) CRYOGENIC REFRIGERATOR

(75) Inventors: Jie Yuan, Shrewsbury, MA (US); James F. Maguire, Andover, MA (US); Ahmed Sidi-Yekhlef, Westborough, MA (US); Peter M. Winn, Shrewsbury, MA (US)

(73) Assignee: American Superconductor Corporation, Westborough, MA (US)

( * ) Notice: Subject to any disclaimer, the term of this patent is extended or adjusted under 35 U.S.C. 154(b) by 0 days.

(21) Appl. No.: 09/716,598

(22) Filed: Nov. 20, 2000

(51) Int. Cl.[7] ..... F25B 9/00

(52) U.S. Cl. ..... 62/6; 62/499; 165/4; 165/10; 165/86

(58) Field of Search ..... 62/6, 499; 165/86, 165/4, 10

(56) References Cited

U.S. PATENT DOCUMENTS

| | | | | |
|---|---|---|---|---|
| 3,612,170 A | * | 10/1971 | Juppet et al. | 165/DIG. 139 |
| 3,626,717 A | | 12/1971 | Lorch | |
| 4,079,273 A | | 3/1978 | Lambrecht et al. | |
| 4,101,793 A | | 7/1978 | Berthet et al. | |
| 4,223,239 A | | 9/1980 | Eckels | |
| 4,275,320 A | | 6/1981 | Baumann et al. | |
| 4,301,858 A | * | 11/1981 | Mock | 165/9 |
| 4,315,172 A | | 2/1982 | Intichar et al. | |
| 4,323,800 A | | 4/1982 | Hofmann | |
| 4,339,680 A | | 7/1982 | Flecher et al. | |
| 4,406,959 A | | 9/1983 | Harano et al. | |
| 4,448,042 A | | 5/1984 | Yamaguchi et al. | |
| 4,727,724 A | | 3/1988 | Intichar et al. | |
| 4,816,708 A | | 3/1989 | Laumond | |
| 4,862,023 A | | 8/1989 | Laumond et al. | |
| 5,032,748 A | | 7/1991 | Sakuraba et al. | |
| 5,269,147 A | | 12/1993 | Ishizaki et al. | |
| 5,412,952 A | | 5/1995 | Ohtani et al. | |
| 5,482,919 A | | 1/1996 | Joshi | |
| 5,513,498 A | | 5/1996 | Ackermann et al. | |
| 5,541,975 A | * | 7/1996 | Anderson et al. | 378/130 |
| 5,680,768 A | | 10/1997 | Rattray et al. | |
| 5,737,927 A | | 4/1998 | Takahashi et al. | |
| 5,744,959 A | | 4/1998 | Jeker et al. | |
| 5,848,532 A | | 12/1998 | Gamble et al. | |

FOREIGN PATENT DOCUMENTS

| | | |
|---|---|---|
| GB | 2 030 787 | 4/1980 |
| JP | HI 129766 | 5/1989 |
| SU | 678-598 | 12/1977 |
| WO | WO 99/04477 | 1/1999 |

OTHER PUBLICATIONS

Gamble, "The Development of a Rotating Liquid Helim Flow Circuit," *an ASME publication*, pp. 2–7 (1978).
Gamble, Superconductive Generator Development, *1975 Joint Power Generation Conference* (*GE*), (1975).
Gamble, "Development of a Helium Transfer Coupling for a Superconducting Generation Rotor," *General Electric Company*, pp. 125–131.
Gamble, et al. "MIT–EEI Superconducting Synchronous Machine" *Massachusetts Institute of Technology*, EEI Project RP–92 pp. 372–381.
Richardson, "Development of a practical pulse tube refrigerator: co–axial designs and the influence of viscosity," *Cyrogenics* 1988 vol. 28,pp. 516–520 (Aug. 1988).

* cited by examiner

*Primary Examiner*—Ronald Capossela
(74) *Attorney, Agent, or Firm*—Fish & Richardson P.C.

(57) ABSTRACT

A cryogenic refrigerator for cooling a rotating device includes a stationary regenerator, and a rotatable cold heat exchanger coupled to the stationary regenerator to rotate relative thereto. The cryogenic refrigerator is, for example, of the Gifford-McMahon type or pulse tube type. In the Gifford-McMahon type, a stationary cylinder houses the regenerator, and a rotatable cylinder mounted to the cold heat exchanger is concentrically arranged about the stationary cylinder. Alternatively, the rotatable cylinder is axially offset of the stationary cylinder. A seal, for example, a ferrofluidic seal, is located between the stationary and rotatable cylinders. In the pulse-tube type, a pulse tube is concentrically arranged about the regenerator, and the cold heat exchanger includes a stationary portion coupled to the regenerator and a rotatable portion coupled to the pulse tube. A back-up valve system is provided for increased reliability.

27 Claims, 4 Drawing Sheets

CRYOGENIC REFRIGERATOR

BACKGROUND

This invention relates to cryogenic refrigerators.

Gifford-McMahon and pulse-tube cryocoolers are known sources of cryogenic refrigeration for cooling superconductor devices. Where the superconductor device is rotating, such as in a superconductor motor, a thermal link, for example, a fan, is provided to couple the stationary cryogenic refrigerator to the rotating device.

SUMMARY

According to one aspect of the invention, a cryogenic refrigerator for cooling a rotating device includes a stationary regenerator, and a rotatable cold heat exchanger coupled to the stationary regenerator to rotate relative thereto.

Embodiments of this aspect of the invention may include one or more of the following features.

The cryogenic refrigerator is of the Gifford-McMahon type. A stationary cylinder houses the regenerator, and a rotatable cylinder mounted to the cold heat exchanger is concentrically arranged about the stationary cylinder. A filler material is located between the stationary and rotatable cylinders.

In an illustrated embodiment, the rotatable cylinder is axially offset of the stationary cylinder and aligned along a common axis. A stem extends from the regenerator. The cylinders define a flow channel therebetween.

A seal, for example, a ferrofluidic seal, is located between the stationary and rotatable cylinders.

In another illustrated embodiment, the cryogenic refrigerator is of the pulse-tube type with a pulse tube concentrically arranged relative to the regenerator, for example, the pulse tube is concentrically arranged about the regenerator. The cold heat exchanger includes a stationary portion coupled to the regenerator and a rotatable portion coupled to the pulse tube. The stationary and rotatable portions of the cold heat exchanger define a flow channel therebetween, and the stationary portion defines a flow channel. The cold heat exchanger includes screens. The cryogenic refrigerator includes a surge volume housing, an aftercooler, and a warm end heat exchanger. The surge volume housing and the aftercooler define a flow orifice therebetween.

According to another aspect of the invention, a method of cooling a rotating superconductor device includes providing a cryogenic refrigerator including a stationary regenerator and a rotatable cold heat exchanger coupled to the stationary regenerator to rotate relative thereto, and coupling the rotatable cold heat exchanger to the superconductor device.

According to another aspect of the invention, a pulse tube cryogenic refrigerator includes first and second valve assemblies for controlling flow between a compressor and a regenerator of the refrigerator, and a controller for detecting failure in the first valve assembly and switching from the first valve assembly to the second valve assembly.

Embodiments of this aspect of the invention may include one or more of the following features.

Each valve assembly includes a rotary valve including a high pressure flow channel and a low pressure flow channel. Alternatively, each valve assembly includes first and second solenoid valves. The pulse tube cryogenic refrigerator includes a valve, for example, first and second solenoid valves, for switching between the first and second valve assemblies, and first and second differential transducers for measuring pressure across the valve assemblies.

Advantages of the invention include the ability to directly couple the refrigerator to a rotating object to cool the rotating object without having to rotate the refrigerator regenerator. Additional advantages include a back-up valve system providing reliability in case of system failure.

Other features, objects, and advantages of the invention will be apparent from the description and drawings, and from the claims.

DETAILED DESCRIPTION

Figure 1:
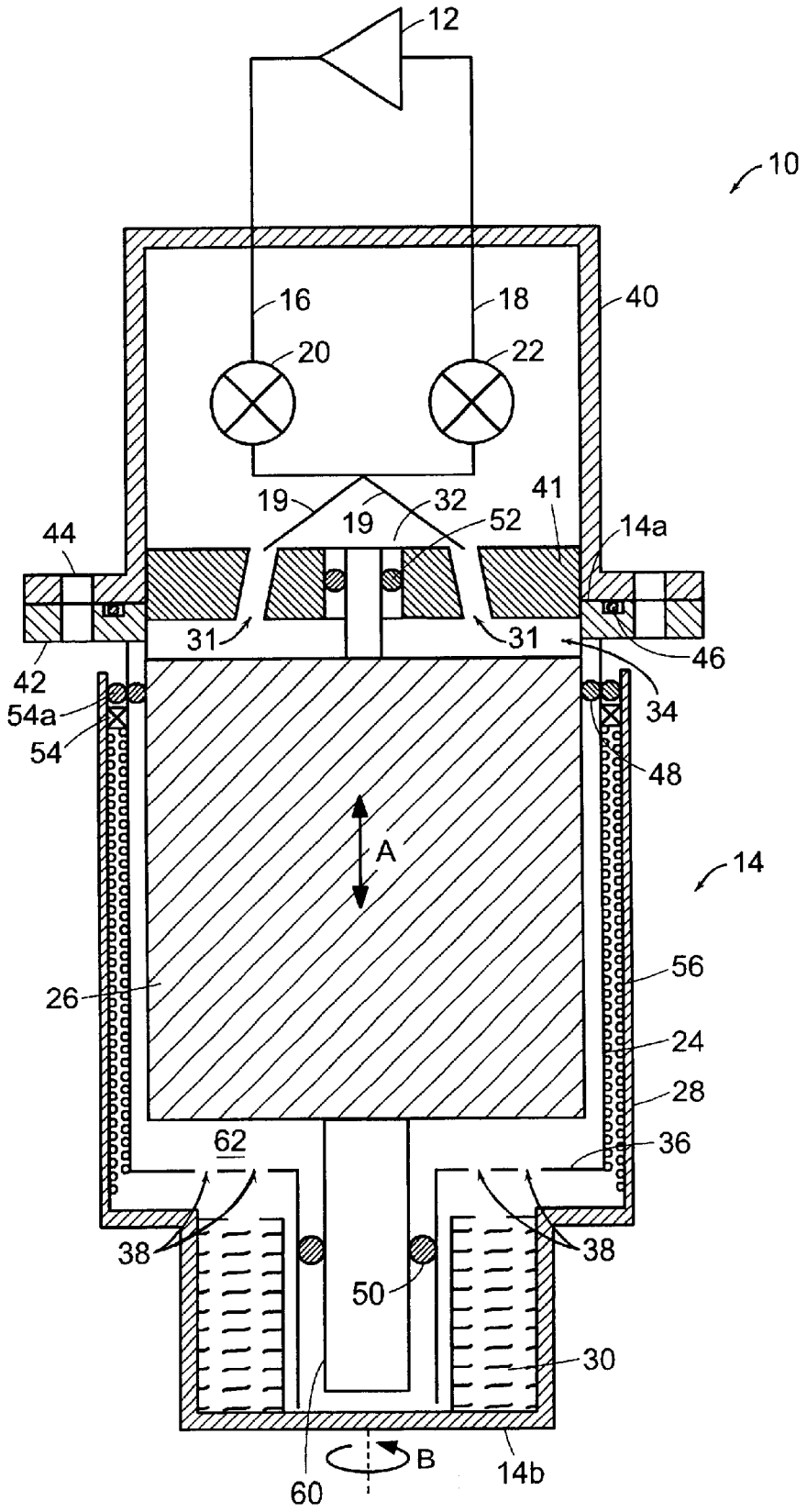
FIG. 1 is a cross-sectional side view of a Gifford-McMahon type cryogenic refrigerator.

Referring to FIG. 1, a cryogenic refrigerator 10, generally of the Gifford-McMahon type, includes a compressor 12 and a cold head 14 connected by inlet and exhaust lines 16, 18, controlled respectively by inlet and exhaust valves 20, 22, for example, single rotary valves. Cold head 14 has a warm end 14*a* and a cold end 14*b*, and includes an inner, stationary cylinder 24, a displacer/regenerator assembly 26 axially movable within cylinder 24 (in the direction of arrow, A), an outer, rotatable cylinder 28, and a cold heat exchanger 30 mounted to rotate with outer cylinder 28 (arrow, B). Cylinder 28 is concentrically arranged about cylinder 24 and is rotatable relative to cylinder 24.

Cylinder 24 defines an upper end volume 34 with gas being delivered to and received from upper end 34 of cylinder 24 through channels 31 defined by a control disk 41 mounted to a control stem 32 of displacer/regenerator assembly 26. Channels 31 communicate with inlet and exhaust lines 16, 18 via lines 19. Displacer/regenerator assembly 26 includes an axially extending stem 60 for gas flow between assembly 26 and cold heat exchanger 30. Cylinder 24 has at its lower end 36 openings 38 which permit cooled gas to pass from heat exchanger 30 into an expansion space 62.

Mounted to cylinder 24 at warm end 14*a* is a housing 40 that encloses valves 20, 22. Cylinder 24 and housing 40 include flanges 42, 44, respectively, with a seal 46, for example, an O-ring seal, positioned therebetween. Between displacer/regenerator 26 and cylinder 24 are further seals 48 and 50, for example, O-ring seals, and between control stem 32 and control disk 41 is a further seal 52, for example, an O-ring seal. At warm end 14*a* of cold head 14, between the stationary and rotating cylinders 24, 28 is a warm ferrofluidic seal 54 and O-ring 54*a*. Between the two cylinders 24, 28 is a space 56 filled with a filler material, for example, foam, to reduce heat losses from warm end 14*a* to cold end 14*b*. Space 56 has a thickness, for example, of a couple mils.

In use, rotatable cylinder 28 is coupled at cold end 14*b* to a rotating machine (not shown) to rotate therewith. Coolant is delivered to heat exchanger 30 by cycling gas within cold head 14, as follows. With displacer/regenerator 26 positioned at lower end 36 of cylinder 24, inlet valve 20 is opened and the pressure in upper end volume 34 above displacer/regenerator 26 is increased from a first pressure $P_1$ to a second, higher pressure $P_2$. The volume below displacer/regenerator 26 is practically zero during this process because displacer/regenerator 26 is at its lowest position. With inlet valve 20 still open and exhaust valve 22 still closed, the displacer/regenerator 26 is moved to the top of cylinder 24. This action moves the gas that was originally in volume 34 down through the displacer/regenerator 26 to expansion space 62. The gas is cooled as it passes through displacer/regenerator 26, decreasing in volume and thus causing more gas to be drawn into cylinder 24 through inlet valve 20 to maintain a constant pressure within the system.

With displacer/regenerator 26 at the top of cylinder 24, inlet valve 20 is closed and exhaust valve 22 is opened, allowing the gas within lower expansion space 62 to expand to the initial pressure $P_1$ as gas escapes from cylinder 24 through exhaust valve 22. Gas that remains within lower space 62 has done work to push out the gas that escapes during this process. Energy is thus removed from the gas that remains in lower space 62, causing the gas remaining in lower space 62 to drop to a lower temperature. The low temperature gas is forced from lower space 62 through heat exchanger 30 by moving displacer/regenerator 26 downward to the bottom of cylinder 24. Heat is transferred to the gas in heat exchanger 30 from the low temperature source, e.g., a superconductor magnet or high-temperature superconductor coil. The gas flows from heat exchanger 30 back through displacer/regenerator 26, in which the gas is warmed back to near ambient temperature.

Other embodiments are within the scope of the following claims.

Figure 2:
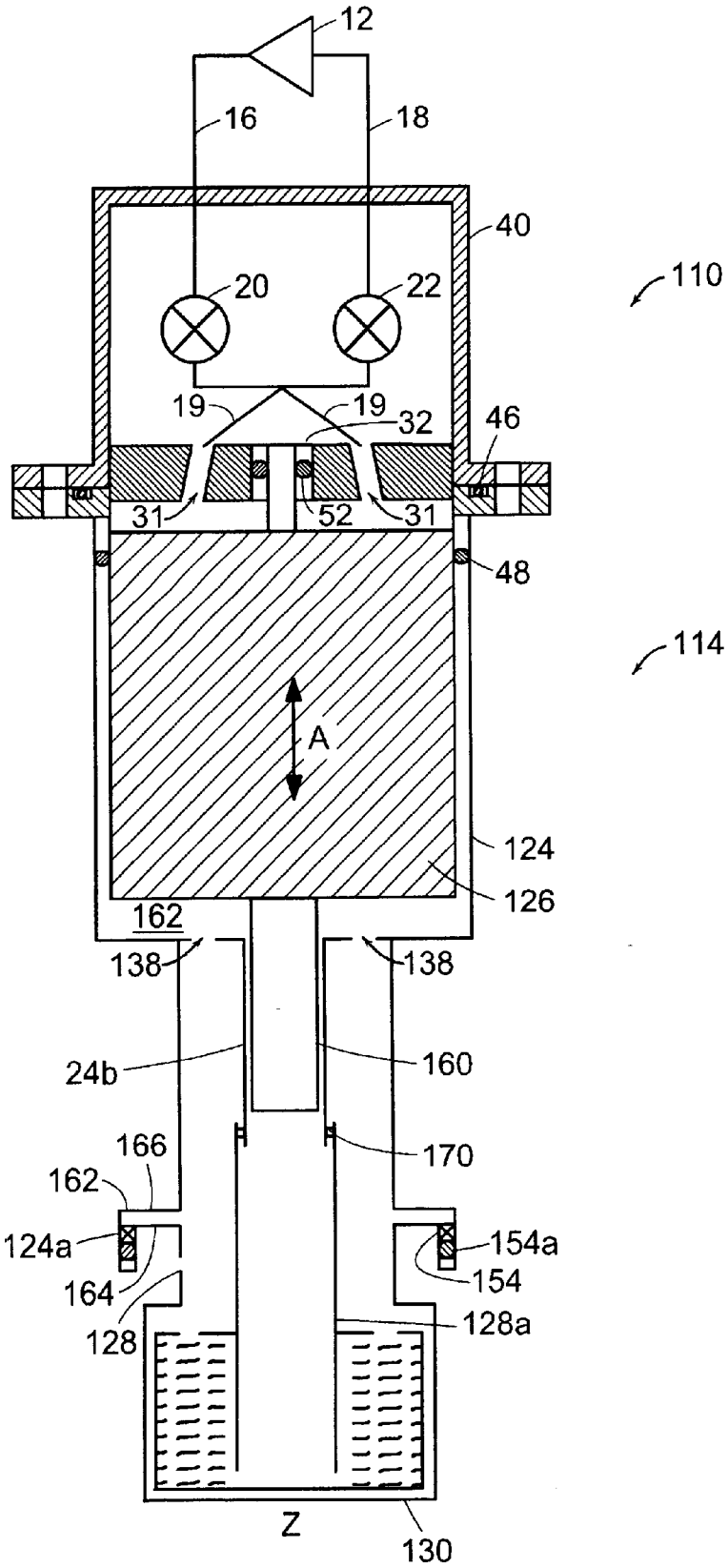
FIG. 2 is a cross-sectional side view of an additional embodiment of a Gifford-McMahon type cryogenic refrigerator.

For example, referring to FIG. 2, a cryogenic refrigerator 110, generally of the Gifford-McMahon type, includes a compressor 12 and a cold head 114 connected by inlet and exhaust lines 16, 18, controlled respectively by inlet and exhaust valves 20, 22. Cold head 114 includes an upper, stationary cylinder 124, a displacer/regenerator assembly 126 axially movable within cylinder 124, a rotatable cylinder 128 arranged axially below cylinder 124 along a common axis, Z, and a cold heat exchanger 130 mounted to rotate with lower cylinder 128. Displacer/regenerator assembly 126 includes an axially extending stem 160 for gas flow between assembly 126 and cold heat exchanger 130. A lower section **124*b* of cylinder 124 defines openings 138 which permit cooled gas to pass from heat exchanger 130 into an expansion space 162**.

At a lower end **124*a* of stationary cylinder 124, between stationary and rotating cylinders 124, 128, is a ferrofluidic seal 154 and O-ring 154*a*. Cylinders 124, 128 include extensions, 162, 164, respectively, which define a long, thin flow channel 166, at the end of which is located seal 154 to distance seal 154 from the coolant to limit heating of the coolant by seal 154. A filler 170, for example, a teflon tube to limit fluid leak, is located between lower, stationary cylinder section 124*b* and an inner, rotating section 128*a* of lower cylinder 128**.

Figure 3:
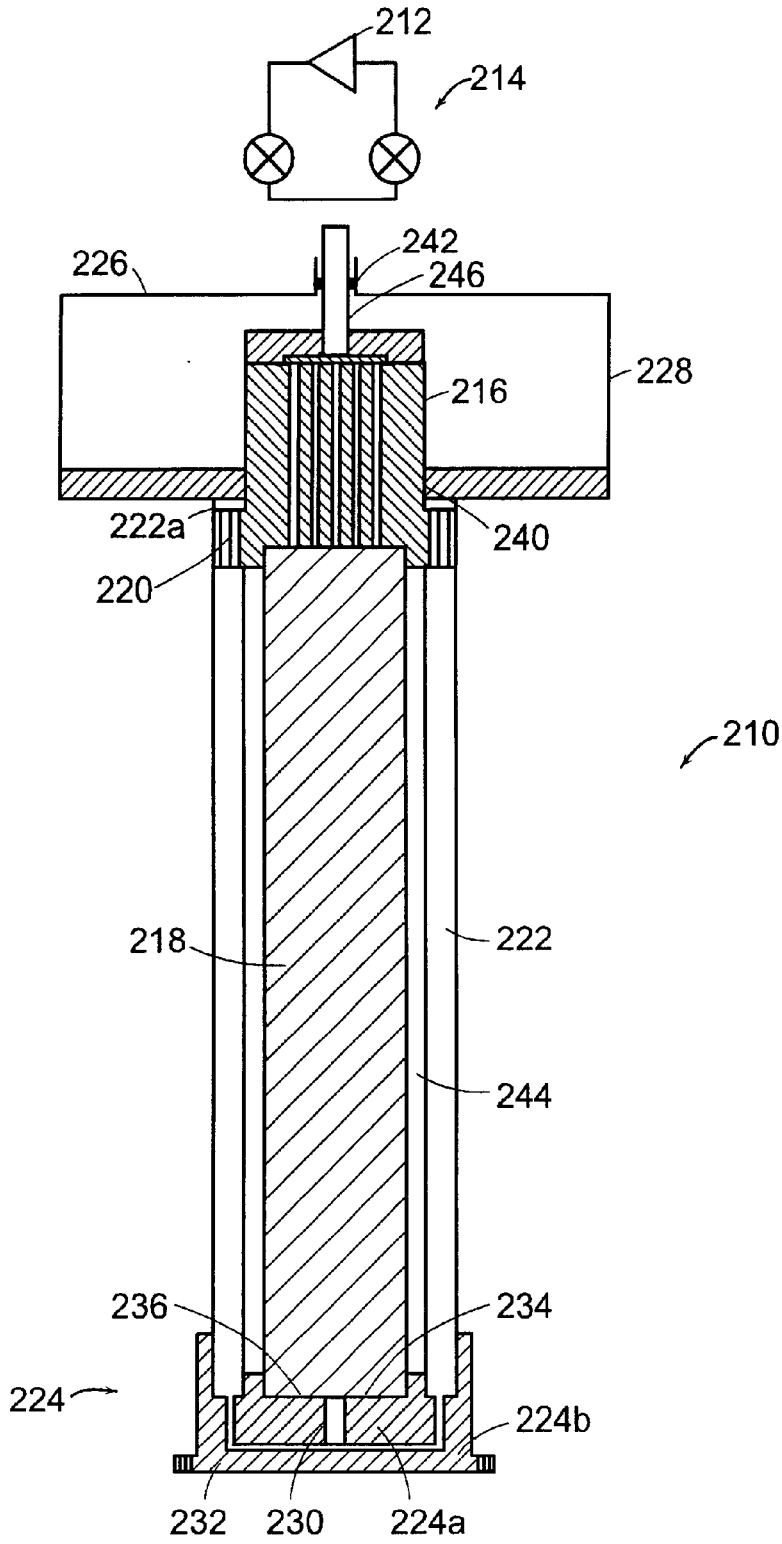
FIG. 3 is a cross-sectional side view of a pulse tube cryogenic refrigerator.

Referring to FIG. 3, a pulse tube refrigerator 210 includes a rotatable cold end heat exchanger 224 for direct coupling to a cryogenic rotating device, not shown. Pulse tube refrigerator 210 includes the following stationary components: a pressure wave generator 212, a valve system 214 connecting to pressure wave generator 212, an aftercooler 216, a regenerator 218, and a warm end heat exchanger 220. Mounted to rotate relative to regenerator 218 is a pulse tube 222. Cold end heat exchanger 224 has a stationary portion **224*a* mounted to regenerator 218 and a rotatable portion 224*b* mounted to pulse tube 222 to rotate therewith. Mounted to pulse tube 222 at the warm end 222*a* of the pulse tube to rotate therewith is a housing 226 enclosing a surge volume 228. Pulse tube 222 and regenerator 218** form a co-axial pulse tube, as described, for example, in Richardson, R. N., "Development of a Practical Pulse Tube Refrigerator: Co-axial Design and influence of Viscosity," *Cryogenics*, Vol. 28, No. 8, p. 516, incorporated by reference herein.

Stationary portion **224*a* of cold end heat exchanger 224 defines a flow channel 230 in fluid communication with a channel 232 defined between stationary and rotating portions 224*a*, 224*b* of cold end heat exchanger 224. Channel 232 is in fluid communication with pulse tube 222. Cold end heat exchanger 224 includes a screen 234 located between a bottom end 236 of regenerator 218 and stationary portion 224*a* of cold end heat exchanger 224**. The narrow flow channels and screen form a large surface area providing high convective heat transfer.

Between the rotatable surge housing 226 and the stationary aftercooler 216 at warm end **222*a* of pulse tube 222 is a clearance 240, which acts as a fluid orifice allowing the gas from pulse tube 222 to travel to surge volume 228. The size of clearance 240 is selected to properly tune pulse tube refrigerator 210, as discussed, for example, in Ohtani et al., U.S. Pat. No. 5,412,952, incorporated by reference herein. For a typical application in which the diameter of aftercooler 216 is about 2 inches, clearance 240 is about 0.01 inches. Between housing 226 and a gas inlet/outlet tube 246 is a seal 242, for example, an O-ring or ferrofluidic warm seal. Pulse tube 222 and regenerator 218 are separated by vacuum insulation 244**.

In use, cold end heat exchanger portion **224*b* is directly coupled to a rotating machine (not shown) to cool the rotating machine. Flow of high pressure room temperature, helium gas at, for example, 18 atm, between compressor 212 and regenerator 218 is controlled by valve assembly 214. The gas pressure is selected to optimize cooler performance. Pulses of gas are delivered to regenerator 218 and travel through channels 230 and 232 to enter pulse tube 222 at a low temperature, for example, about 30–80 K. Gas within pulse tube 222 is compressed, followed by expansion when valve assembly 214 is actuated to allow reverse flow. The expansion of the gas within pulse tube 222** causes the gas to cool to a lower temperature, for example, about 20–70 K.

To provide increased system reliability, it is advantageous to have redundant components in the critical systems, such as the cryogenic refrigerator, of a high-temperature superconductor device. While the cost of a full redundant refrigeration system including a cold head and a compressor can be cost prohibitive, in a pulse-tube type cryocooler, as the only moving part is the rotary valve assembly which generates the pressure wave, effective redundancy can be obtained by adding a second valve assembly connected and controlled such that should a failure occur in the first valve assembly, the second valve assembly takes over control of the system and the operation of the superconducting device is not disturbed.

The operation of pulse tube refrigerator systems is described for example in Ishizaki et al, U.S. Pat. No. 5,269,147, and Ohtani et al, U.S. Pat. No. 5,412,952, both incorporated by reference herein in their entirety. Briefly, in a pulse tube refrigerating systems, a working fluid contained within a tube is compressed adiabatically by the introduction of pressurized fluid into the tube causing an increase in the temperature of the working fluid. Working fluid which has been compressed passes to a heat exchanger to transfer heat into the atmosphere. The pressurized fluid is then allowed to flow from the tube and working fluid returns to the tube and expands to decrease in temperature. The cooled working fluid passes to a refrigerating section where it is available as a coolant. The compression and expansion cycle is repeated.

Figure 4:
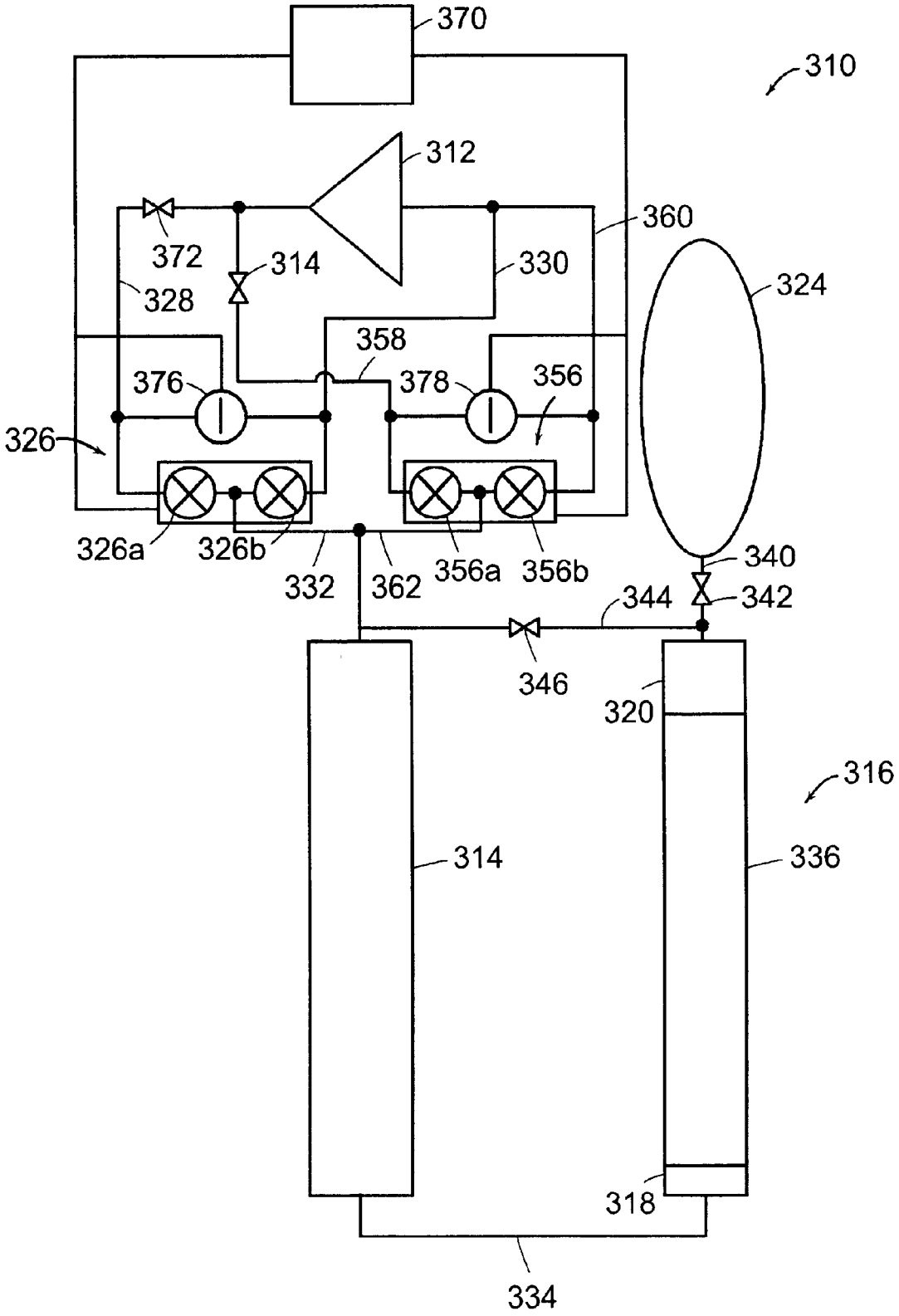
FIG. 4 is a schematic of a pulse tube cryogenic refrigerator including a secondary valve assembly.

With reference to FIG. 4, a pulse tube refrigerator system 310 includes a compressor 312, a regenerator 314, and a pulse tube 316. Pulse tube 316 includes a cold end heat exchanger 318 and a warm end heat exchanger 320. Attached to warm end heat exchanger 320 of pulse tube 316 is a buffer 324.

The flow of high pressure room temperature gas, for example, helium gas, at, for example, 18 atm, between compressor 312 and regenerator 314 is controlled by a valve assembly 326, for example, a rotary valve including a high pressure flow channel 326*a* and a low pressure flow channel 326*b*. Alternatively, valve assembly 326 can include two solenoid valves. The gas pressure is selected based upon desired system efficiency. Gas flows from compressor 312 to high pressure flow channel 326*a* through an inlet line 328, and from low pressure channel 326*b* to compressor 312 through an outlet line 330. High pressure flow channel 326*a* is controlled to deliver pulses of gas to regenerator 314 through a gas line 332. Gas delivered to regenerator 314 travel through a gas line 334 and enters pulse tube 316 at cold end 318. Gas within a tube 336 of pulse tube 316 is compressed, followed by expansion when low pressure flow channel 326*b* is actuated to allow reverse flow through lines 334 and 332. The expansion of the gas within pulse tube 316 causes the gas to cool.

Gas flow to and from buffer 324 through a flow line 340 is controlled by a valve 342. Gas flow into and out of warm end heat exchanger 320 of pulse tube 316 through a flow line 344 is controlled by a valve 346.

The desired reliability in case of system failure is obtained by providing a back-up valve assembly 356, for example, a rotary valve including high and low pressure flow channels 356*a*, 356*b*, respectively. Alternatively, valve assembly 356 can include two solenoid valves. Gas flows from compressor 312 to high pressure flow channel 356*a* through an inlet line 358, and from low pressure flow channel 356*b* to compressor 312 through an outlet line 360. High pressure flow channel 356*a* is controlled to deliver pulses of gas to regenerator 314 through a gas line 362. Gas within tube 336 expands when low pressure flow channel 356*b* is actuated to allow reverse flow through lines 334 and 362.

Opening and closing of flow lines 326*a*, 326*b*, 356*a* and 356*b*, as well as detection of valve failure in valve assembly 326 and switching from valve assembly 326 to valve assembly 356, is controlled by controller 370.

Located within each of inlet lines 328 and 358 is a solenoid valve 372, 374, respectively. Solenoid valve 372 is normally open to allow flow through line 328, and solenoid valve 374 is normally closed to prevent flow through line 358. Located across each valve assembly 326, 356 is a differential pressure transducer 376, 378, respectively.

If valve assembly 326 fails, the differential pressure across the valve will either increase beyond the maximum set value of transducer 376 or decrease below the minimum set valve of transducer 376. Transducer 376 senses the change in pressure and provides a signal to controller 370. In response to the pressure change, controller 370 provides a signal to solenoid 372 to close and a signal to solenoid 374 to open, thereby switching from valve assembly 326 to valve assembly 356. Valve assembly 356 fuinctions until valve assembly 326 is repaired or changed.

In the compressor system 312, the pump is the most likely component to fail and a second pump can be installed, connected, and controlled to assume operation should the first pump fail, again without disruption to the superconducting system.

The secondary valve assembly can be used with the pulse tube system of FIG. 3.

Other embodiments are within the scope of the following claims.

What is claimed is:

1. A cryogenic refrigerator for cooling a rotating device, comprising:

a stationary regenerator, and a rotatable cold heat exchanger coupled to the stationary regenerator to rotate relative thereto.

2. The cryogenic refrigerator of claim 1 wherein the cryogenic refrigerator is of the Gifford-McMahon type.

3. The cryogenic refrigerator of claim 1 further comprising a stationary cylinder housing the regenerator.

4. The cryogenic refrigerator of claim 3 further comprising a rotatable cylinder mounted to the cold heat exchanger.

5. The cryogenic refrigerator of claim 4 wherein the rotatable cylinder is concentrically arranged about the stationary cylinder.

6. The cryogenic refrigerator of claim 5 further comprising a filler material located between the stationary and rotatable cylinders.

7. The cryogenic refrigerator of claim 4 wherein the rotatable cylinder is axially offset of the stationary cylinder.

8. The cryogenic refrigerator of claim 7 wherein the cylinders are aligned along a common axis.

9. The cryogenic refrigerator of claim 7 further comprising a stem extending from the regenerator.

10. The cryogenic refrigerator of claim 7 wherein the cylinders define a flow channel therebetween.

11. The cryogenic refrigerator of claim 4 further comprising a seal located between the stationary and rotatable cylinders.

12. The cryogenic refrigerator of claim 11 wherein the seal comprises a ferrofluidic seal.

13. The cryogenic refrigerator of claim 1 wherein the cryogenic refrigerator is of the pulse-tube type.

14. The cryogenic refrigerator of claim 1 further comprising a pulse tube concentrically arranged relative to the regenerator.

15. The cryogenic refrigerator of claim 14 wherein the pulse tube is concentrically arranged about the regenerator.

16. The cryogenic refrigerator of claim 14 wherein the cold heat exchanger includes a stationary portion coupled to the regenerator and a rotatable portion coupled to the pulse tube.

17. The cryogenic refrigerator of claim 16 wherein the stationary and rotatable portions of the cold heat exchanger define a flow channel therebetween.

18. The cryogenic refrigerator of claim 16 wherein the stationary portion of the cold heat exchanger defines a flow channel.

19. The cryogenic refrigerator of claim 14 wherein the cold heat exchanger includes a screen.

20. The cryogenic refrigerator of claim 14 further comprising a surge volume housing and an aftercooler.

21. The cryogenic refrigerator of claim 20 wherein the surge volume housing and the aftercooler define a flow orifice therebetween.

22. The cryogenic refrigerator of claim 14 further comprising a warm end heat exchanger.

23. The cryogenic refrigerator of claim 14 further comprising first and second valve assemblies for controlling flow between a compressor and a regenerator of the refrigerator, and a controller for detecting failure in the first valve assembly and switching from the first valve assembly to the second valve assembly.

24. A cryogenic refrigerator for cooling a rotating device, comprising:

a stationary regenerator, a stationary cylinder housing the regenerator, a rotatable cold heat exchanger coupled to the stationary regenerator to rotate relative thereto, a rotatable cylinder mounted to the cold end heat exchanger and concentrically arranged about the stationary cylinder, and a ferrofluidic seal located between the stationary and rotatable cylinders.

25. A cryogenic refrigerator for cooling a rotating device, comprising:

a stationary regenerator, a stationary cylinder housing the regenerator, a rotatable cold heat exchanger coupled to the stationary regenerator to rotate relative thereto, a rotatable cylinder mounted to the cold end heat exchanger and arranged axially offset of the stationary cylinder along a common axis, the rotatable and stationary cylinders defining a flow channel therebetween, and a ferrofluidic seal located within the flow channel.

26. A cryogenic refrigerator for cooling a rotating device, comprising:

a stationary regenerator, a rotatable pulse tube concentrically arranged about the regenerator, a cold end heat exchanger including a stationary portion coupled to the regenerator and a rotatable portion coupled to the pulse tube, a surge volume housing coupled to the pulse tube to rotate therewith, and an aftercooler coupled to the regenerator, the surge volume housing and the aftercooler defining a flow orifice therebetween.

27. A method of cooling a rotating superconductor device, comprising:

providing a cryogenic refrigerator including a stationary regenerator and a rotatable cold heat exchanger coupled to the stationary regenerator to rotate relative thereto, and coupling the rotatable cold heat exchanger to the superconductor device.

* * * * *